US006263535B1

(12) United States Patent
Wang

(10) Patent No.: US 6,263,535 B1
(45) Date of Patent: Jul. 24, 2001

(54) APPARATUS FOR CLEANING CAKING ADHERED ON THE INNER WALL OF PIPE

(75) Inventor: Chung Chih Wang, Taichung (TW)

(73) Assignee: Winbond Electronics Corp., Hsinchu (TW)

( * ) Notice: Subject to any disclaimer, the term of this patent is extended or adjusted under 35 U.S.C. 154(b) by 0 days.

(21) Appl. No.: 09/366,924

(22) Filed: Aug. 4, 1999

(30) Foreign Application Priority Data

Aug. 5, 1998 (TW) ..... 87212771

(51) Int. Cl.[7] ..... F23J 3/02
(52) U.S. Cl. ..... 15/104.16; 15/104.066
(58) Field of Search ..... 15/104.05, 104.066, 15/104.067, 104.068, 104.069, 104.09, 104.095, 104.096, 104.11, 104.13, 104.16, 104.2, 301, 304

(56) References Cited

U.S. PATENT DOCUMENTS 615,427 * 12/1898 Casaday ..... 15/104.13
1,145,626 * 7/1915 Stover ..... 15/104.16
2,157,493 * 5/1939 Miller et al. ..... 15/104.069
4,964,921 * 10/1990 Lloyd ..... 15/104.066
5,045,289 * 9/1991 Bengel et al. ..... 15/104.095
5,966,767 * 10/1999 Lu et al. ..... 15/104.16

FOREIGN PATENT DOCUMENTS

565182 * 11/1932 (DE) ..... 15/104.066
1524324 * 5/1968 (FR) ..... 15/104.066
27777 * 11/1897 (GB) ..... 15/104.066

* cited by examiner

*Primary Examiner*—Terrence R. Till
(74) *Attorney, Agent, or Firm*—Ladas & Parry

(57) ABSTRACT

The present invention provides a scrubbing device retractably movable into a pipe to effectively separate caking from the pipe. The scrubber comprises a plurality of metal brush wheels or is provided with bristles. The scrubber is moved into the pipe by a flexible rod, and the rod can be retractably and automatically received in a chamber by a winding machine therein. Each of the brush wheels can be formed with a plurality of helical teeth located on the circumference thereof. The caking adhered on the inner wall of the pipe can be cleanly scrubbed away by the teeth, and then the removed caking and its ashes can be effectively expelled out of the pipe by the suction of a vacuum cleaner.

5 Claims, 7 Drawing Sheets

APPARATUS FOR CLEANING CAKING ADHERED ON THE INNER WALL OF PIPE

BACKGROUND OF THE INVENTION

1. Field of the Invention

This invention relates to a cleaning apparatus. In particular, it relates to a cleaning apparatus used to clean caking adhered on the inner wall of a pipe.

2. Description of Prior Art

In fab, the arrangement of various pipes for transmitting waste gases is extensive and complex. Waste gas mixed with particles and toxic gases exhausted from etching and deposition processes are transmitted to a waste gas treatment device by pipes. These particles are gradually adhered onto the inner wall of the pipe and accumulate into caking over time. The toxic gases remained in these pipes are harmful to human being and environment. However, because of the complex arrangement of the pipes, it is difficult to dismantle the desired pipes for cleaning.

SUMMARY OF THE INVENTION

To solve the above problem, the primary object of this invention is to provide a scrubbing device retractably moved into the pipes to effectively separate the caking from the pipe. The scrubber comprises metal brush wheels formed with helical teeth or is provided with bristles. The scrubber is moved into the pipes by a flexible rod, and that rod can be retractably and automatically received in a chamber by a winding machine therein.

The present invention is characterized in that each of the brush wheels is formed with a plurality of helical teeth located on the circumference thereof. The caking adhered on the inner wall of the pipe can be scrubbed away by the teeth and then it is expelled out off the pipes by the suction of a vacuum cleaner.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

Figure 1:
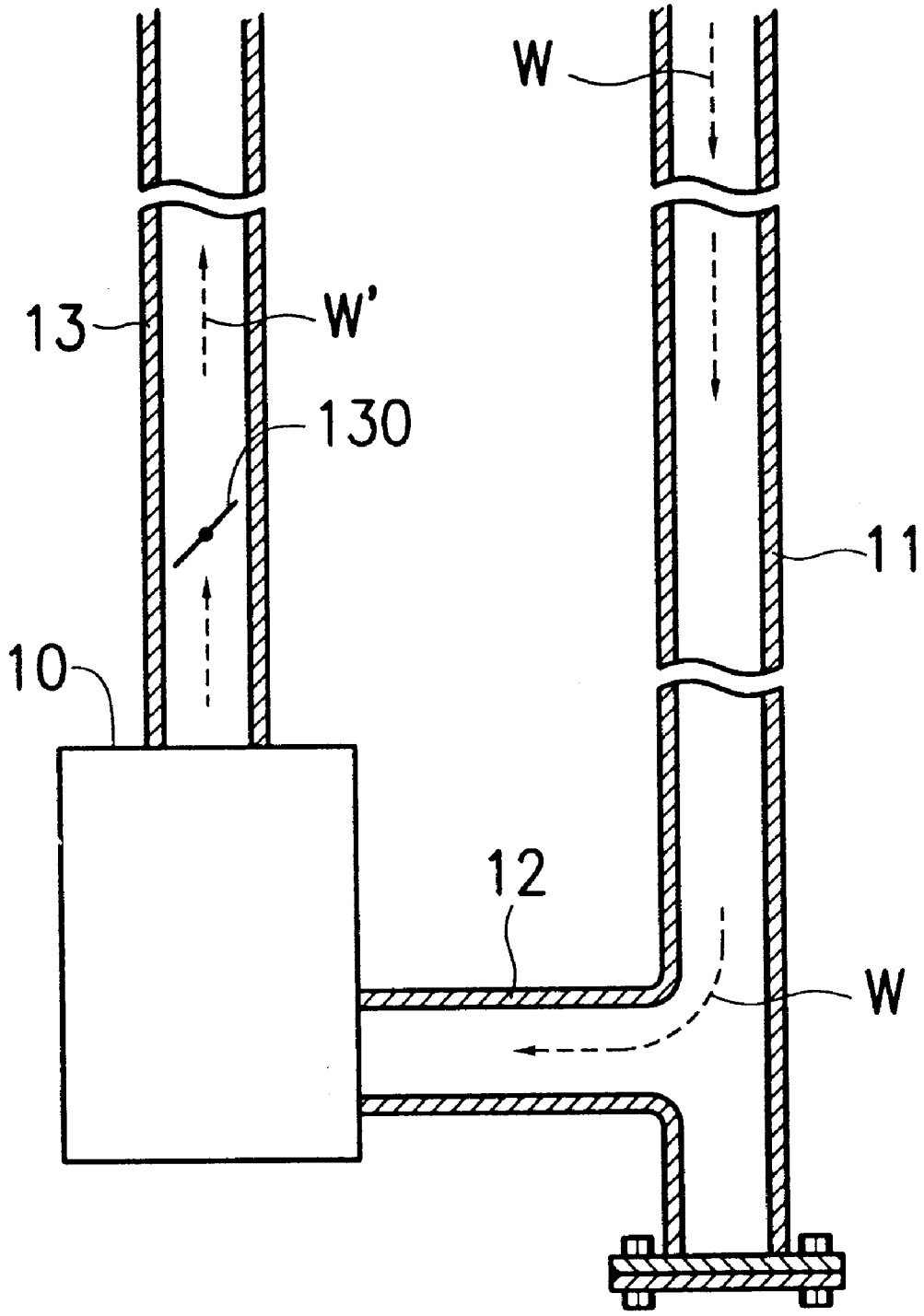
FIG. 1 is a schematic diagram partially showing the structure of a waste gas treatment device according to a semiconductor fab.

Referring to FIG. 1, a schematic diagram shows the general structure of a waste gas treatment device 10 of a semiconductor fab. The waste gas W exhausted from the fab is inducted into the waste gas treatment device 10 through the inlet pipes 11 and 12, and then the treated gas W' is generated and expelled out off the device 10 through the pipe 13. A valve 130 is disposed in the exhaust pipe 13 so as to regulate the flow rate of the treated gas W'.

Figure 2A:
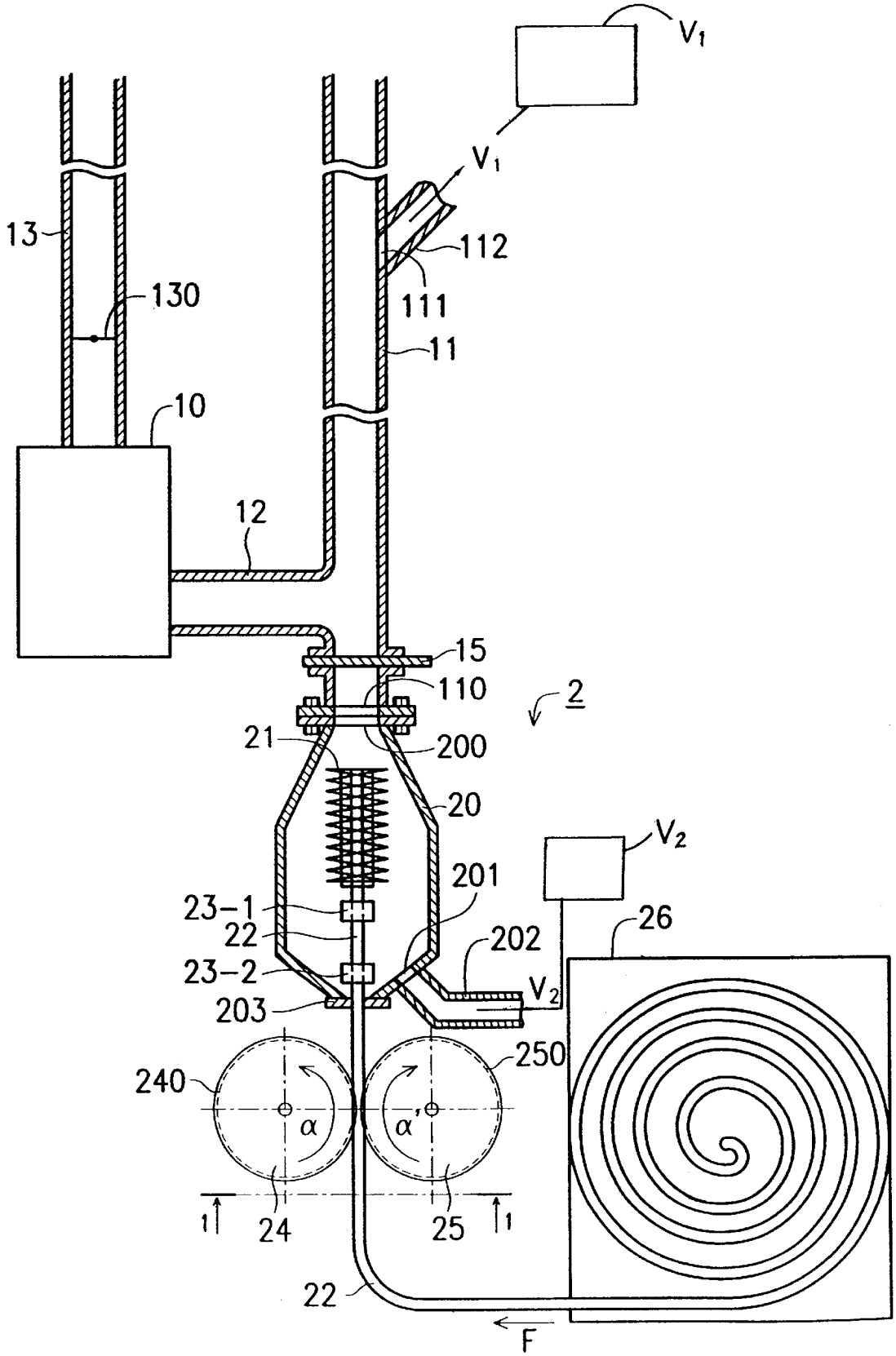
FIG. 2A is a schematic diagram showing a cleaning apparatus mounted on one pipe of the waste gas treatment device according to the first embodiment of the present invention.

Referring to FIG. 2A, a schematic diagram shows the cleaning apparatus 2 mounted on the opening 110 of pipe 11 of the waste gas treatment device 10 according to the first embodiment of the present invention. The present invention provides a gate 15 disposed on the end of the pipe 11 near the opening 110. When the pipes are being cleaned, the valve 130 should be closed.

The cleaning apparatus 2 comprises a housing 20 with an opening 200 used to connect to the pipe 11, a scrubber 21 with bristles retractably disposed in the housing 20, and a driving device used to move the scrubber 21 backward and forward in the pipe 11. The driving device comprises a flexible rod 22, a guiding mechanism 24, 25 and a chamber 26. The flexible rod 22 is a longitudinal strip connected to the scrubber 21 at one end, with part of the rod 22 left outside of the chamber 26 and the rest one received in the chamber 26. In the chamber 26, a winding machine (not shown in FIGS.) is provided and the flexible rod 22 can be automatically and retractably received therein. Two guiding members 23-1, 23-2 mounted in the housing 20 are used to guide the flexible rod 22 to move in a predetermined direction, so that the scrubber 21 can be correctly moved out of the housing 20 through the opening 200. In addition, a pipe 112 is communicated with the pipe 11 via an opening 111 and a pipe 202 is communicated with the housing 20 via an opening 201. Both of the pipes 112, 201 are connected to a vacuum cleaner (not shown in Figs.).

Figure 2B:
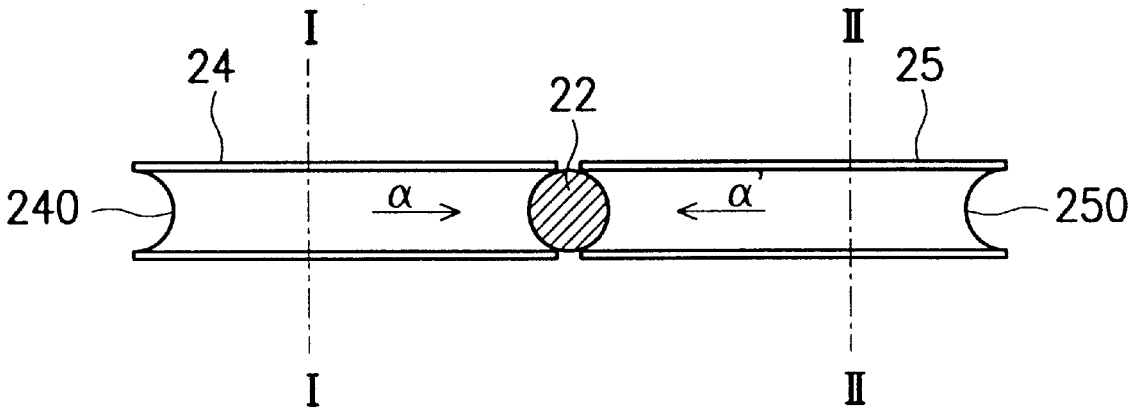
FIG. 2B is a cross-sectional view showing the relationship between a flexible rod and two spaced rollers of the cleaning apparatus according to line l—l of FIG. 2A.

Referring to FIG. 2B, a cross-sectional view shows the relationship between the flexible rod 22 and the guiding mechanism according to line l—l of FIG. 2A. The guiding mechanism comprises two rollers 24, 25 spaced a distance apart from each other and rotated in the opposite directions $\alpha$, $\alpha'$. As shown in FIG. 2B, each of the rollers 24, 25 are respectively formed with circular recesses 240, 250, and the rod 22 is forcedly clamped therebetween and moved thereby.

Figure 3:
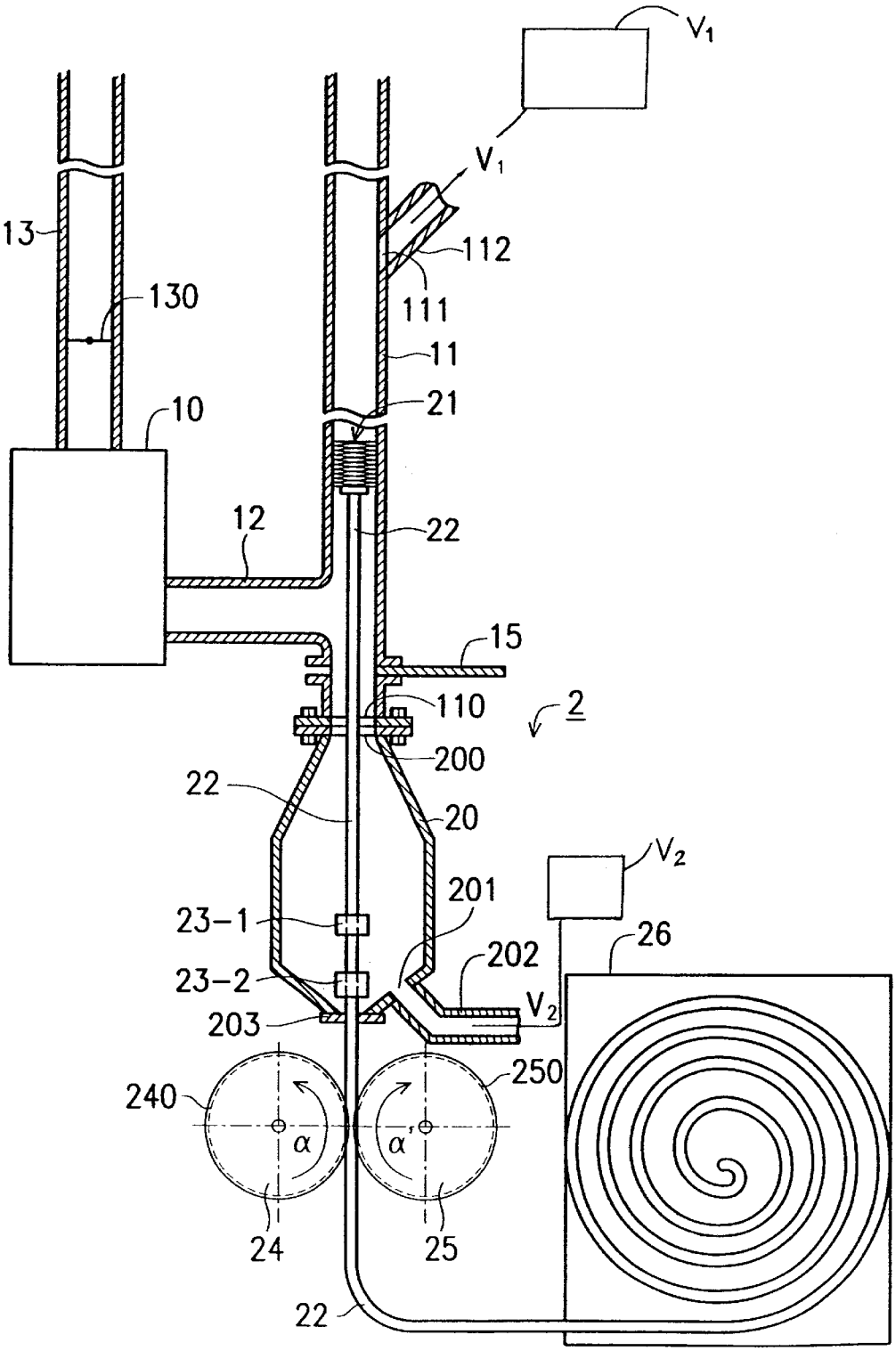
FIG. 3 is a schematic diagram showing a scrubber of the cleaning apparatus being fed and moved into the pipe according to FIG. 2A.

Referring to FIG. 3, when the gate 15 is open and the scrubber 21 is forcedly fed into the pipe 11, the scrubber 21 can be moved forward and backward therein according to the rotating direction of the rollers 24, 25. Therefore, caking can be easily scrubbed off the inner wall of the pipe 11 by reciprocal movement of the scrubber 21 and then the removed caking and its ashes are effectively sucked by the vacuum cleaners $V_1$ and $V_2$ via the pipes 112, 202 along the directions $V_1$, $V_2$, respectively.

Figure 4A:
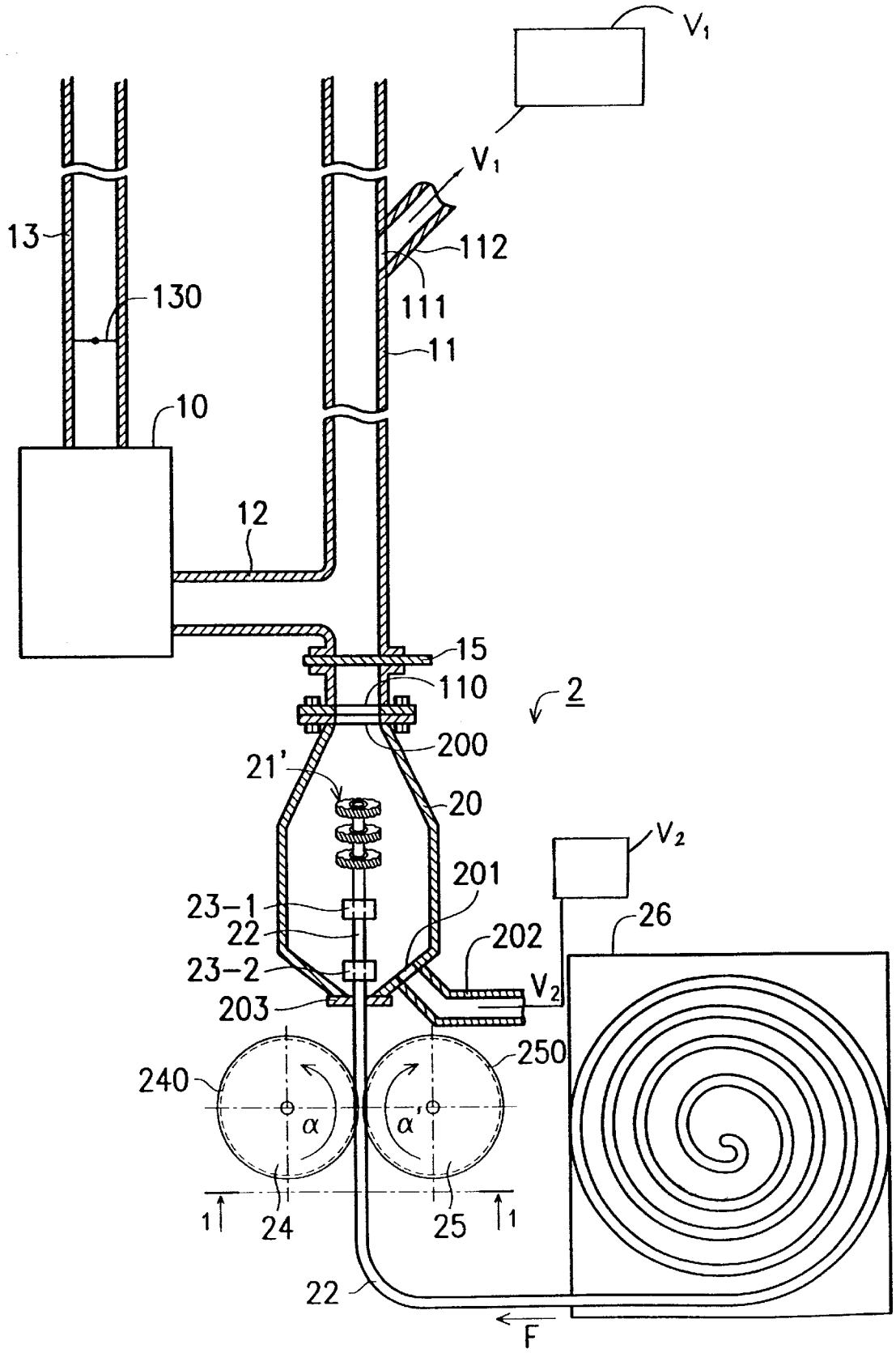
FIG. 4A is a schematic diagram showing a cleaning apparatus mounted on one pipe of the waste gas treatment device according to the second embodiment of the present invention.
Figure 4B:
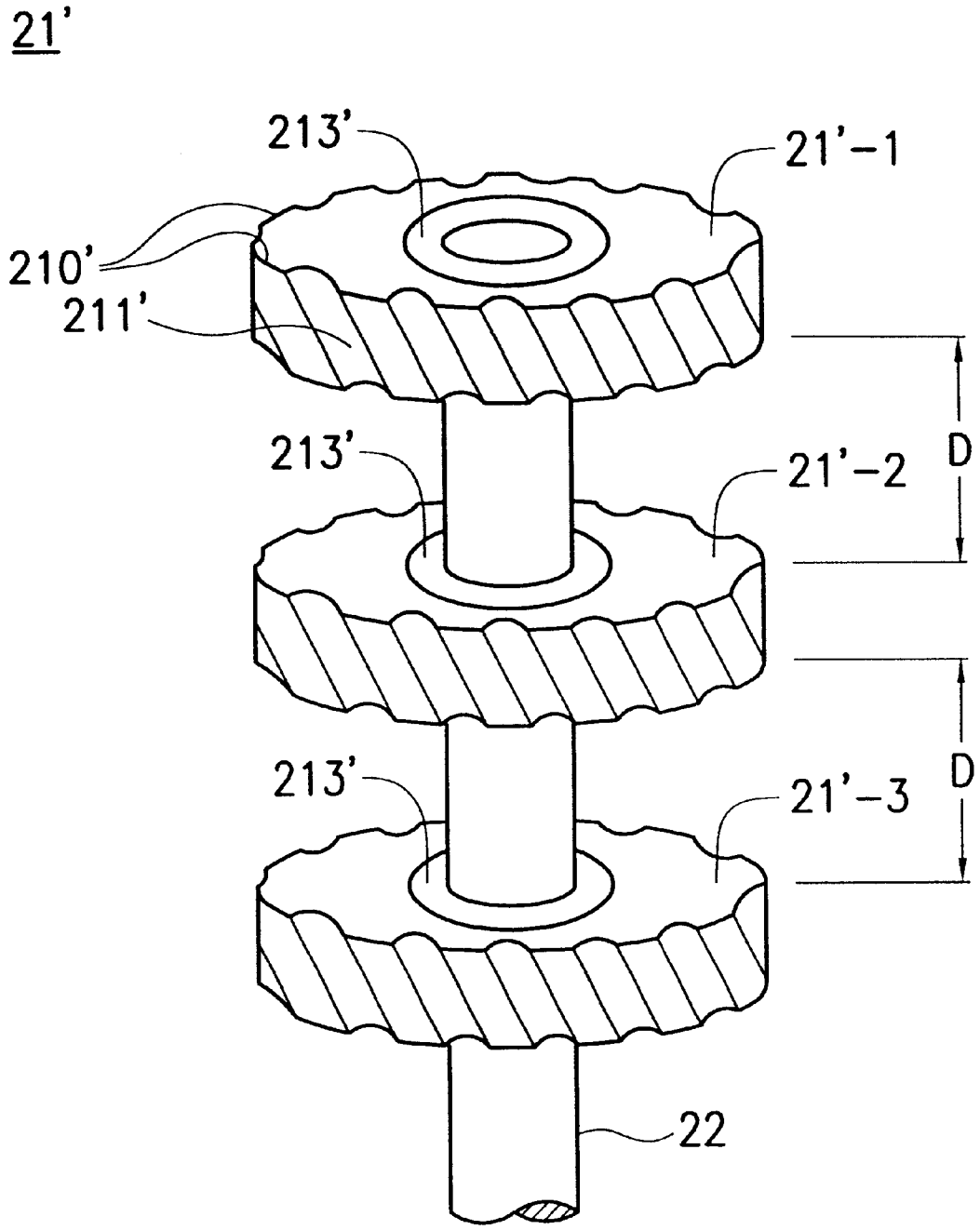
FIG. 4B is an enlarged perspective view showing the structure of another embodied scrubber according to FIG. 4A.
Figure 5:
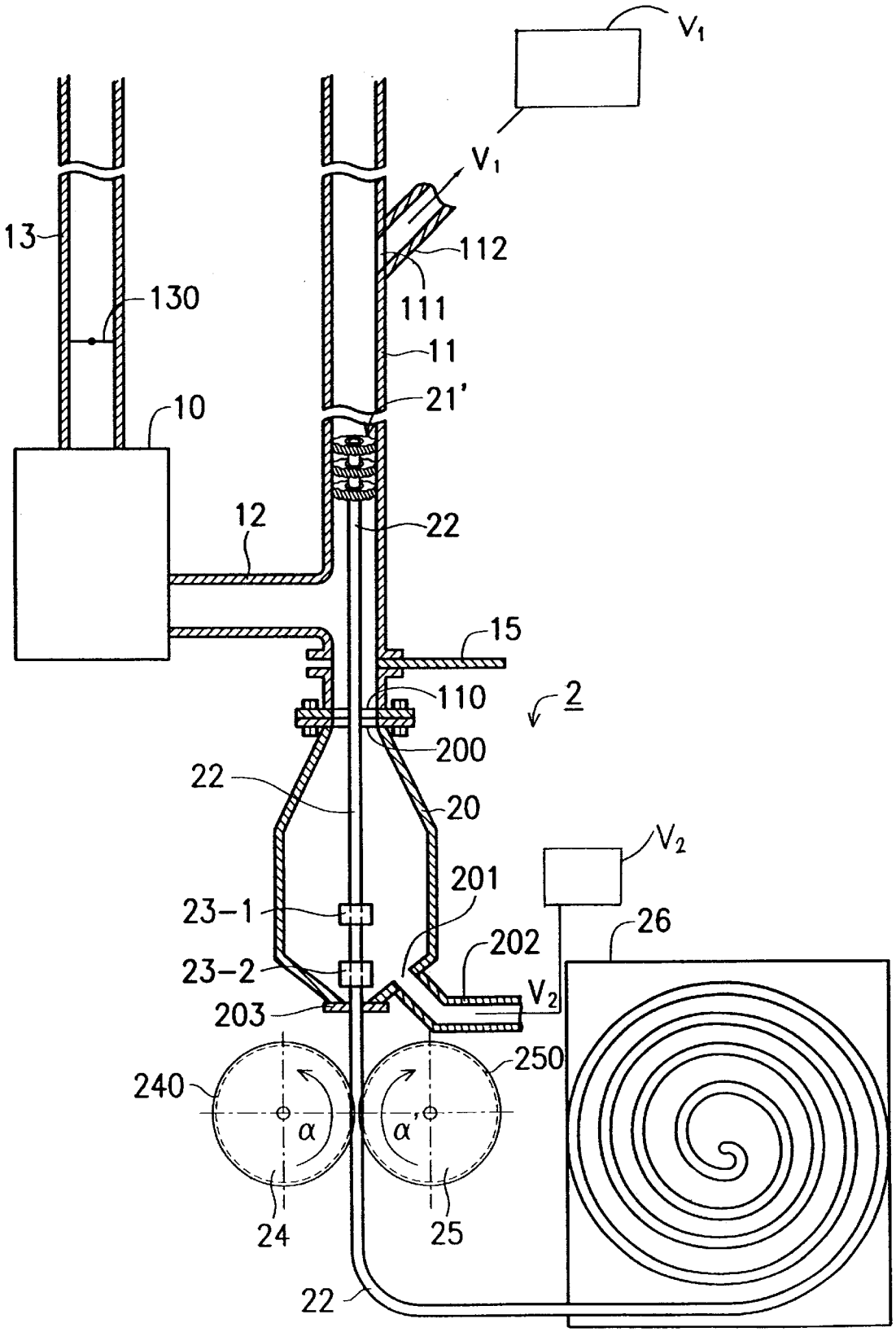
FIG. 5 is a schematic diagram showing the scrubber of the cleaning apparatus being fed and moved into the pipe according to FIG. 4A.

FIG. 4A shows a schematic diagram of the second embodiment of the present invention provided with a scrubber 21', and FIG. 4B shows an enlarged perspective view of the structure of the scrubber 21' according to FIG. 4B. The difference between the second embodiment and the first embodiment is in that the scrubber 21' is composed of metal brush wheels 21'-1, 21'-2 and 21'-3.

Referring to FIG. 4B, the brush wheels 21'-1, 21'-2 and the brush wheels 21'-2, 21'-3 are the same and spaced a distance D apart from each other, respectively. Each of the wheels is rotatably mounted on the flexible rod 22 by the connection of a bearing 213' therebetween. The brush wheel 21'-1, for example, is formed with a plurality of helical teeth 210' located on the circumference thereof, and each pair of teeth 210', 210' are provided with a groove 211'.

When the scrubber 21' is fed into the pipe 11 by the flexible rod 22, the helical teeth 210' of each of the wheels

21'-1, 21'-2, 21'-3 are forcedly contacted against the inner wall of the pipe 11. The wheels 21'-1, 21'-2, 21'-3 scrub the inner wall of the pipe 11 with teeth 210' and then the removed caking and its ashes are expelled away the scrubber 21' through grooves 211'.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for cleaning caking adhered on the inner wall of a pipe, said apparatus comprising:

(a) a housing connected to said pipe, said housing having an opening used to communicate with said pipe;

(b) a scrubber for separating said caking from said pipe, said scrubber being retractably received in said housing and moved into said pipe through the opening; and (c) a driving means for driving said scrubber into said pipe and for retracting said scrubber to be received in said housing, wherein said driving means comprises:

(c1) a flexible rod connected to said scrubber:

(c2) a guiding mechanism used for feeding said flexible rod moving into said pipe; and (c3) a chamber used to retractably receive said flexible rod, wherein said guiding mechanism comprises at least two adjustable rollers for feeding said flexible rod into said pipe, and wherein said scrubber comprises a plurality of brush wheels spaced a distance apart from each other and rotatably mounted on said flexible rod, each of brush wheels being provided with helical teeth.

2. The apparatus as claimed in claim 1 further comprising a sucking device connected to said pipe and said housing so as to expel said caking peeled out off said pipe.

3. The apparatus as claimed in claim 2, wherein said sucking device is a vacuum cleaner.

4. An apparatus for cleaning caking adhered on the inner wall of a pipe, said apparatus comprising:

(a) a housing connected to said pipe, said housing having an opening used to communicate with said pipe;

(b) a scrubber for separating said caking from said pipe, said scrubber being retractably received in said housing and moved into said pipe through the opening; and (c) a driving means for driving said scrubber into said pipe and for retracting said scrubber to be received in said housing, wherein said driving means comprises:

(c1) a flexible rod connected to said scrubber;

(c2) a guiding mechanism used for feeding said flexible rod moving into said pipe; and (c3) a chamber used to retractable receive said flexible rod, wherein said guiding mechanism comprises at least two adjustable rollers for feeding said flexible rod into said pipe, wherein said scrubber is provided with bristles, and further comprising a sucking device connected to said pipe and said housing so as to expel said caking peeled out of said pipe.

5. The apparatus as claimed in claim 4, wherein said sucking device is a vacuum cleaner.

* * * * *